US005322041A

United States Patent [19]

Niemeier et al.

[11] Patent Number: 5,322,041

[45] Date of Patent: Jun. 21, 1994

[54] EMERGENCY SHUT-DOWN ARRANGEMENT FOR A DIESEL ENGINE

[75] Inventors: Gerd Niemeier, Stuttgart; Bernd Sigle, Weinstadt; Frank Thoma, Stuttgart, all of Fed. Rep. of Germany

[73] Assignee: Mercedes-Benz A.G., Stuttgart, Fed. Rep. of Germany

[21] Appl. No.: 94,515

[22] Filed: Jul. 19, 1993

[30] Foreign Application Priority Data

Aug. 25, 1992 [DE] Fed. Rep. of Germany ..... 4228154

[51] Int. Cl.[5] ..... F02B 77/00

[52] U.S. Cl. ..... 123/198 DB; 123/DIG. 11; 210/429

[58] Field of Search ..... 123/198 DB, DIG. 11; 210/418, 429

[56] References Cited

U.S. PATENT DOCUMENTS

| | | | |
|---|---|---|---|
| 2,726,770 | 12/1955 | Sette | 210/429 |
| 2,751,930 | 6/1956 | Redner | 210/429 |
| 3,004,670 | 10/1961 | Zonker | 210/429 |
| 4,082,673 | 4/1978 | Cilento | 210/429 |
| 4,529,515 | 7/1985 | Selz | 210/234 |
| 4,731,183 | 3/1988 | Schumacher | 210/419 |

FOREIGN PATENT DOCUMENTS

| | | |
|---|---|---|
| 15468Ia | 10/1955 | Fed. Rep. of Germany . |
| 1270665 | 4/1972 | United Kingdom . |

*Primary Examiner*—Noah P. Kamen
*Attorney, Agent, or Firm*—Klaus J. Bach

[57] ABSTRACT

An emergency shut-off device for an air-compressing internal combustion engine is provided in the filter head of the engine fuel filter for the purpose of shutting off the fuel supply for shutting down the engine when the engine cannot be turned off by the ignition key.

6 Claims, 2 Drawing Sheets

EMERGENCY SHUT-DOWN ARRANGEMENT FOR A DIESEL ENGINE

BACKGROUND OF THE INVENTION

The invention relates to an emergency shut-down arrangement for a diesel engine.

An emergency shut-off device of this kind is already known from German Patent Application D15468Ia/46b[2] of Jul. 11, 1953.

As is known, diesel engines with mechanically governed injection pump are often shut off pneumatically when the ignition key is turned off. However if there is a fault in the vacuum system, the pneumatic shut-off function is no longer guaranteed. It is therefore customary to provide an emergency shut-off device in the engine compartment to allow the engine to be shut down despite a defect in the vacuum system.

According to the publication "Mercedes-Benz Manual 28.04.89, Type 200-300 D-Mechanical stopping of the engine", an emergency shut-off lever is mounted on the injection pump by which the control rod of the injection pump can be manually pulled back to a zero fuel delivery position.

This shut-off lever is located at a point in the engine compartment to which access is difficult so that it is virtually impossible to actuate the lever except by using an auxiliary means, e.g., a screwdriver.

It is the principal object of the present invention to provide an easily accessible emergency shut-down system for a diesel engine by which the engine can be shut down if the engine fails to stop when turned off.

SUMMARY OF THE INVENTION

An emergency shut-down arrangement for diesel engine is provided in the filter head of the engine fuel filter for the purpose of shutting off the fuel supply for shutting down the engine when the engine cannot be turned off by the ignition key.

The special positioning of the emergency shut-off device in the head of the fuel filter, which is placed in the upper region of the engine compartment to allow rapid changing of the filter, provides for direct, unobstructed access to the emergency shut-off device. The use of auxiliary means for the actuation of the engine stop facility is therefore no longer necessary.

DESCRIPTION OF THE PREFERRED EMBODIMENT

Figure 1:
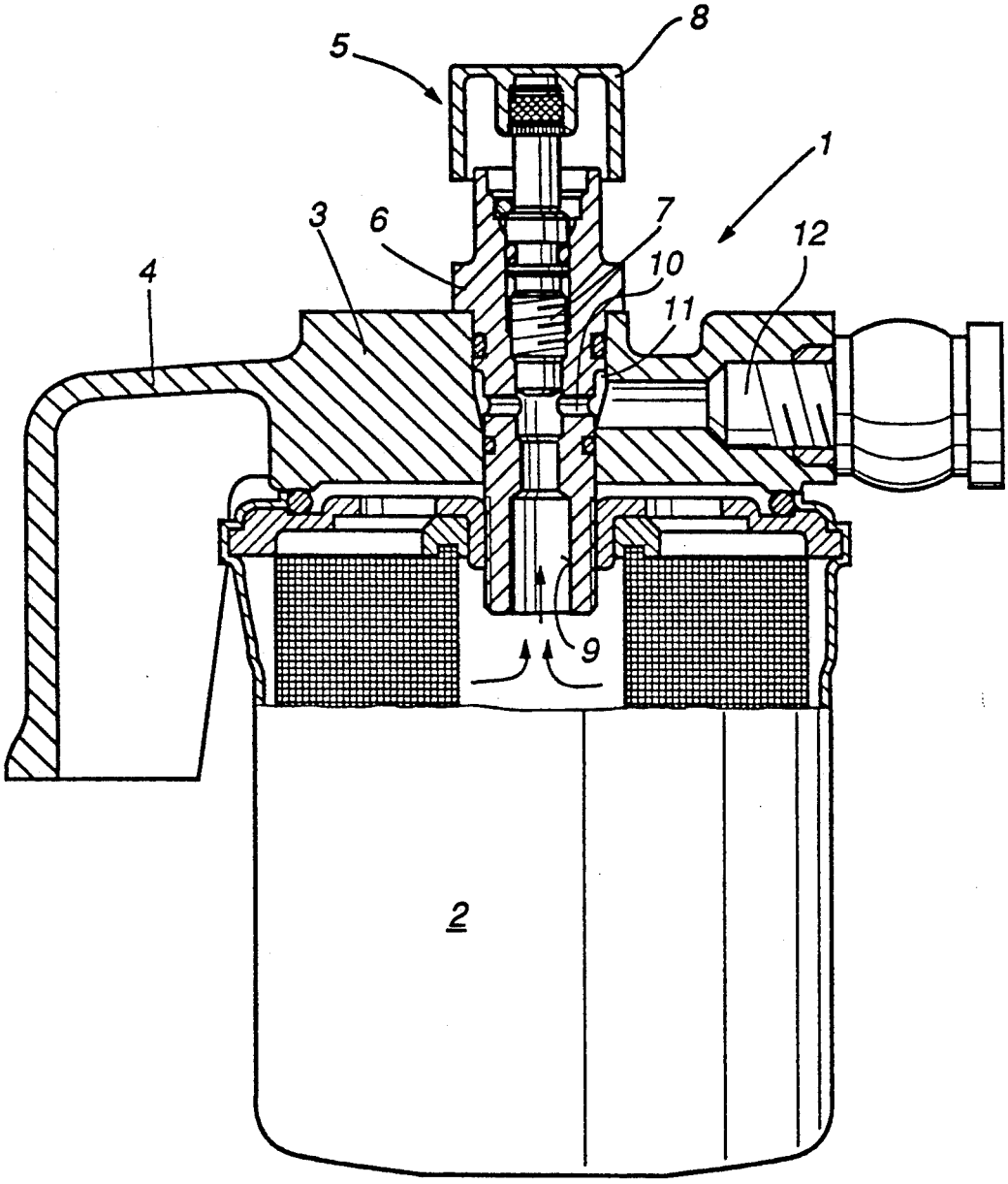
FIG. 1 shows in cross-section an emergency shut-off device according to the invention in the head of a fuel filter.

FIG. 1 shows a fuel filter 1 for a diesel internal combustion engine which comprises an exchangeable filter box 2 and a filter head 3 with a filter holder 4.

The filter head 3 contains a centrally situated emergency shut-off device 5 which comprises a hollow screw 6 and a valve spindle 7 guided therein. The valve element 7 is designed as a shut-off spindle and is firmly connected at its free end, which projects out of the hollow screw 6, to an actuating knob designed as a rotary knob 8.

Figure 2:
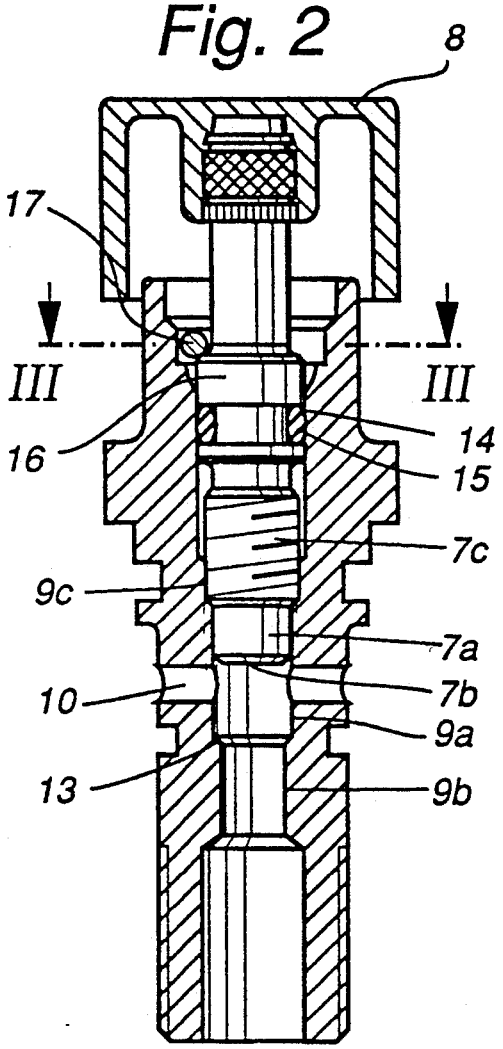
FIG. 2 is an enlarged cross-sectional view of the emergency shut-off device.
Figure 3:
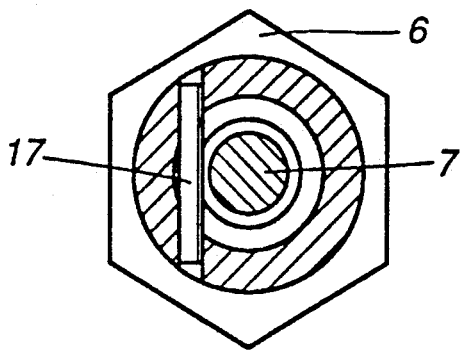
FIG. 3 is a cross-sectional view of the emergency shut-off device taken along the line III—III in FIG. 2.

The hollow screw 6 has a multi-step axial passage 9 and a transverse hole 10 which intersects the axial passage and is in communication with an annular chamber 11 bounded by the hollow screw 6 and the filter head 3 and from which an outlet passage 12 extends in the filter head 3. The portion **9*a* (FIG. 2) of the axial passage in the region of the transverse hole 10 is larger in diameter than the upstream portion 9*b* of the passage. The transition between the two portions 9*a*, 9*b* of the passage forms a tapered valve seat 13 for the valve spindle 7 which, on its spigot 7*a*, has a tapered seating surface 7*b* matched with the valve seat 13. Above this spigot 7*a*, the valve spindle 7 is provided with a thread 7*c*. There is a corresponding thread 9*c* in the axial passage 9, above the transverse hole 10. The valve spindle 7 is provided with a guide collar 16 which contains an annular groove 14 receiving a seal ring 15 and, in the initial position of the valve spindle 7, rests against a pin 17 which passes eccentrically through the hollow screw 6 (FIG. 3) and prevents removal of the valve spindle from the hollow screw 6**.

If the vacuum system becomes defective such that the pneumatic engine shut-off system fails, an emergency shut-down of the engine is achieved by actuating the easily accessible emergency shut-off device 5, that is, by turning the rotary knob 8 causing the spigot 7 to shut off the transverse hole 10 and close the axial passage 9 until the valve spindle 7 rests on the valve seat 13. The supply of fuel is then interrupted. Due to the lack of fuel, the engine then ceases to operate after about 30 seconds. The rotary knob 8 is then turned in the opposite direction until the valve spindle 7 rests against the pin 17.

Figure 4:
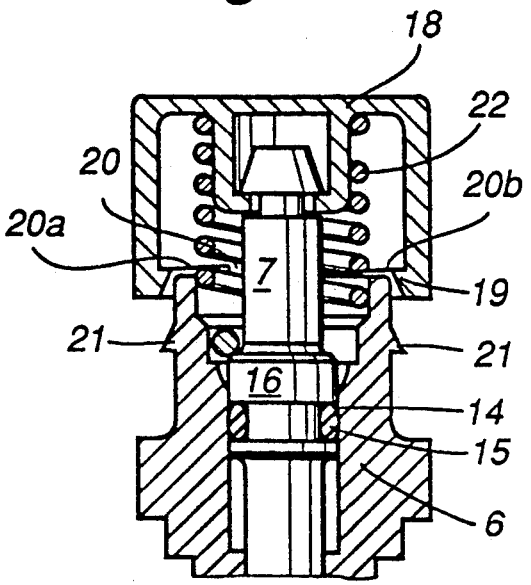
FIG. 4 shows in cross-section another embodiment of an emergency shut-off device.

Another exemplary embodiment as shown in FIG. 4 utilizes a pushbutton arrangement. The valve spindle 7, which is of essentially identical design is, however, without a thread and the rotary knob is replaced by a pushbutton 18 clipped onto the valve spindle 7. The cup-like pushbutton 18 is provided on the inside, at its free end, with a catch ring 19 which has two diametrically opposite openings 20 which divide the catch ring into two halves of equal length each having oblique ramps **20*a*, 20*b* extending in the circumferential direction and acting as sliding surfaces for two catch projections 21 formed on the outside of the hollow screw 6. The numeral 22 denotes a compression spring which rests at one end on the hollow screw 6 and at the other end on the pushbutton 18**.

In the event of an emergency shut-down, the pushbutton 18 is pressed down so that the catch ring 19 slides over the catch projections 21 with a slight expansion and then engages the latter. A slight rotation of the pushbutton presses the spigot **7*a* of the valve element 7 onto the valve seat 13 since the ramps 20*a*, 20*b* have a slight pitch due to the obliquely extending ramps. Unlocking is achieved by rotating the pushbutton 18 in the opposite direction until the openings 20 reach the catch projections 21. The pushbutton 18 with the valve element 7 is then returned to its initial position by the compression spring 22**.

Figure 5:
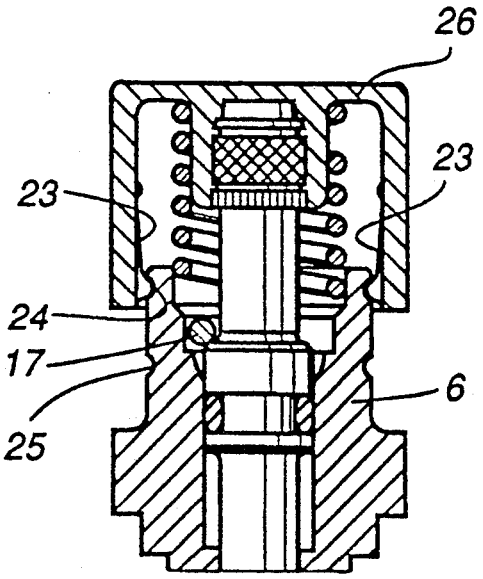
FIG. 5 shows a particularly simple embodiment.

The embodiment of FIG. 5 is particularly simple since, instead of the threaded connection between the valve spindle 7 and the hollow screw 6 provided in FIG. 1, the actuating knob, which is designed as a pushbutton 23, has on the inside two catch springs 24 which, in the initial position of the valve spindle 7, are received in an upper catch groove 25 and, in the closed position, in a lower annular groove 26 in the hollow screw 6. The need for rotation of the actuating knob is eliminated since in this case it is sufficient to press the knob down for closing the spindle valve and pull the actuating knob. It is preferably in the form of a pushbutton 26, which is firmly connected to the valve spindle 7.

What is claimed is:

1. An emergency shut-down arrangement for a diesel engine including a fuel injection pump for injecting fuel into said engine and a fuel filter with a filter head for filtering fuel supplied to the injection pump, said arrangement including an emergency fuel shut-off device integrated into the filter head of said fuel filter for interrupting the fuel supply to the injection pump of the engine and comprising a hollow screw firmly screwed into said filter head and including a passage for conducting fuel through said filter to said injection pump and a valve spindle movably guided in a sealing manner in said hollow screw and provided with an actuating knob by means of which said valve spindle can be moved between an open position permitting fuel flow through said filter to said injection pump and a closed position in which said flow of fuel is interrupted.

2. An arrangement according to claim 1, wherein said hollow screw has a transverse hole intersecting said axial passage and said passage has two sections of different diameters with a transition between the two sections disposed upstream of the intersection with the transverse hole, said transition forming a tapered valve seat for seating the valve spindle.

3. An arrangement according to claim 1, wherein said valve spindle is threaded into said hollow screw so as to be movable axially by rotation thereof and has its free end firmly connected to the actuating knob for rotation of said valve spindle.

4. An arrangement according to claim 1, wherein said valve spindle is axially slidable in said passage and said actuating knob is a pushbutton mounted on said valve spindle so as to be axially movable therewith, said pushbutton being cup-shaped and having at its inside a catch ring provided with at least one oblique ramp extending in the circumferential direction which interacts, in the shut-off position of the valve spindle, with at least one catch projection arranged on the outside of said hollow screw for engaging said catch ring and retaining said pushbutton and wherein a compression spring is supported between the pushbutton and the hollow screw, said catch ring having at least one opening to permit its release from said catch projection in a particular angular position thereof.

5. An arrangement according to claim 1, wherein said valve spindle is axially movably supported in said passage and said actuating knob is a cup-shaped pushbutton having on the inside thereof at least one catch spring structure which interacts with axially spaced catch grooves provided on the hollow screw and arranged so as to retain said valve spindle in a fuel flow-permitting and a shut-off position respectively.

6. An arrangement according to claim 1, wherein a retaining pin extends eccentrically through said hollow screw and said valve spindle has a collar to be engaged by said retaining pin for retaining said valve spindle within said hollow screw.

* * * * *